US007603724B2

(12) United States Patent
Mickle

(10) Patent No.: US 7,603,724 B2
(45) Date of Patent: Oct. 20, 2009

(54) HOOD WITH HINGED MASK PIECE

(75) Inventor: Bill Mickle, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 205 days.

(21) Appl. No.: 11/012,151

(22) Filed: Dec. 16, 2004

(65) Prior Publication Data

US 2006/0130213 A1 Jun. 22, 2006

(51) Int. Cl.
*A42B 1/18* (2006.01)

(52) U.S. Cl. ..... 2/173; 2/184.5; 2/202; 2/203; 2/206; 2/209.11

(58) Field of Classification Search ..... 2/423, 2/424, 84, 171.4, 173, 202, 206, 209.11, 2/203, 204, 171, 172, 410, 9, 468, 425, 205; 206/213, 278, 8; 128/201.22, 201.23, 201.24, 128/201.25, 201.29
See application file for complete search history.

(56) References Cited

U.S. PATENT DOCUMENTS

| | | | | | |
|---|---|---|---|---|---|
| 159,497 | A | | 2/1875 | Brugger et al. | |
| 1,431,287 | A | * | 10/1922 | Cohn | 2/172 |
| 2,039,478 | A | * | 5/1936 | Ensten | 2/203 |
| D189,233 | S | | 11/1960 | Gardner | |
| 2,998,611 | A | | 9/1961 | Schuessler | |
| 3,271,781 | A | | 9/1966 | Sontag et al. | |
| 3,307,202 | A | * | 3/1967 | Schuessler | 2/173 |
| 3,717,882 | A | | 2/1973 | Schuessler | |
| 3,885,558 | A | * | 5/1975 | Belkin | 128/201.25 |
| 4,573,217 | A | * | 3/1986 | Reed | 2/7 |
| 4,941,211 | A | | 7/1990 | Blutstein | |
| D334,830 | S | | 4/1993 | Siegel | |
| 5,809,572 | A | | 9/1998 | Sisolak | |
| 5,822,800 | A | * | 10/1998 | Anderson | 2/202 |
| 5,836,303 | A | * | 11/1998 | Hurst et al. | 128/206.24 |
| 6,088,838 | A | * | 7/2000 | Sontag | 2/202 |
| 6,499,141 | B1 | * | 12/2002 | Egnew | 2/69 |
| 6,512,159 | B1 | * | 1/2003 | Shesol et al. | 602/41 |
| 6,654,963 | B2 | * | 12/2003 | Fayle et al. | 2/84 |
| 6,662,375 | B2 | | 12/2003 | Lewis | |
| 7,028,345 | B2 | * | 4/2006 | Waldman | 2/468 |
| 7,152,252 | B2 | * | 12/2006 | Gellis et al. | 2/206 |
| 2002/0069449 | A1 | | 6/2002 | Blutstein et al. | |
| 2006/0117470 | A1 | * | 6/2006 | Hofmann | 2/457 |
| 2006/0143796 | A1 | * | 7/2006 | Bugarin | 2/202 |
| 2006/0253958 | A1 | * | 11/2006 | Debrick | 2/206 |

* cited by examiner

*Primary Examiner*—Gary L Welch
*Assistant Examiner*—Sally C Cline
(74) *Attorney, Agent, or Firm*—Sughrue Mion, PLLC

(57) ABSTRACT

A hood is provided that includes a lid and a mask which are pivotally connected and separately moveable. The mask and lid form an opening that increases or decreases in size when the mask pivots. The lid is moveable between an up and down position. In the up-position, an edge of the lid is disposed on a user's forehead and in the down-position the edge is disposed on a posterior of the user's head. The mask is connected to the lid by a hinge portion which allows the mask to provide varying levels of coverage to a user's face.

23 Claims, 9 Drawing Sheets

HOOD WITH HINGED MASK PIECE

BACKGROUND OF INVENTION

1. Field of Invention

This invention relates to a hood and, more particularly, to a hood which may be worn while participating in outdoor sporting or athletic activities. The hood furnishes a comfortable, non-bulky construction while providing warmth and moisture management.

2. Description of the Related Art

Outdoor athletics have become increasingly popular causing clothing manufacturer's to produce apparel that meets the needs of outdoor enthusiasts and athletes. It is known to provide a hood for covering a user's head and face. However, the prior art has suffered from not sufficiently advancing athletic wear to provide a hood that is both fashionable, functional and comfortable.

Balaclavas are well known for providing a close-fitting knitted covering for the head and neck, leaving only the face, or parts of it exposed. Such a hood is disclosed in Schuessler U.S. Pat. No. 2,998,611, which in an unstretched state covers almost the entire face of a user, exposing only his eyes and the bridge of his nose through a face opening. The user may try to roll the hood back and thereby expose a top portion of the user's head when environmental conditions do not require full head protection or when the user wishes to release heat from the head area. On the other hand, the user may desire to stretch the fabric downward to expose the nose, cheeks, mouth and chin of the wearer to release heat.

A disadvantage of the above-noted types of hoods is that because of the stretching, the material of the hood tends to lose its elasticity and not properly return to its original untensioned state, leading to diminished protection, especially if the material of the hood is knitted. This problem may be exacerbated if the material has picked up moisture from rain or a user's breath. Further, when the hood is initially rolled back, a lower portion of the opening may cause an uncomfortable amount of stress to a lower portion of the user's nose. These problems are particularly evident for people participating in athletic activities who frequently wish to expose their upper head or face, while not entirely removing their hood.

Efforts have been made to address problems associated with hoods that lose their elastically and fail to maintain their shape. For example, Schuessler U.S. Pat. No. 3,717,882 provides fasteners that control the shape of a facial opening by clinching together a top and bottom central portion of the opening when maximum facial coverage is desired leaving only the user's eyes exposed. However, such a design requires a user to manually snap together the fasteners, which may be inappropriate if the user is participating in an activity that would otherwise require his attention. Also, the use of a metal or plastic fastener could potentially scratch a user's face during a contact sport.

It has also been proposed to provide a hood having a crown covering portion attached to a neck piece, as in Ensten U.S. Pat. No. 2,039,478. Such a design is deficient due to its use of a knitted material that looses its ability to maintain a form fitting shape, as in the previously mentioned references. Further, the hood of Ensten only provides limited coverage of a user's face. This limited coverage results from the neck piece being secured in one position, thus, reducing its ability to comfortably provide varying levels of coverage to a user's face area.

SUMMARY OF INVENTION

An aspect of the present invention is to provide a hood that is comfortable and versatile. The unique design provides varying levels of coverage for total heat management of a user's head, face and, neck. Additionally, the hood position can be adjusted while wearing with a minimal amount of effort and without the need to excessively stretch the hood.

According to an exemplary embodiment, a hood is provided having a lid and a mask pivotally attached to the lid. The mask has opposite side portions that respectively overlap the lid and slide along the lid when the mask is lowered or raised. The mask and the lid circumscribe an opening such that when the mask pivots, the size of the opening increases or decreases.

The mask also has two rear edges that are both attached to the lid to form a first set of connection areas. The mask may be attached to a side of the lid at a second set of connection areas that are separate from the first set of connection areas. The second set of connection areas being disposed lower than the first set of connection areas.

According to an embodiment, bottom edges of the lid and mask define a neck hole. In addition, side portions of the mask are separable from the hood to form through holes that open at respective upper edges of the side portions and exit at lower edges of the side portions. The lower edges of the side portions being positioned above the bottom edges of the lid and the mask.

In accordance with a further aspect of the invention, the lid has an edge which borders part of the opening and is configured to be disposed on a user's head in one of an up-position and a down-position. The edge of the lid is disposed on a user's forehead when in the up-position and is disposed on a posterior of a user's head while in the down-position. Further, the portion of the mask attached to the lid forms a hinge which allows the mask to be moved from a first position, which covers a nose of the user, to second position, which is below the user's nose and over a mouth of the user. The second position being obtained by moving the mask in a downward direction such that an edge of the mask slides along an outside of the lid. The mask is operable to be moved from the second position to a third position that is below the mouth of the user and on a chin of the user. Similarly, the mask is operable to be moved from the third position to a fourth position that is under the chin of the user.

According to a further exemplary embodiment, a hood is provided with a face piece and a head piece. The head piece has a crown portion and a lower edge. The face piece includes a lower edge that is attached to the lower edge of the head piece to define a neck hole and also includes hinge portions that are attached to the head piece. The hinge portions each have a lower edge that extends towards a back of the hood and is positioned above the neck hole. The hinge portions also have upper edges which, along with the lower edges, are separable from the head piece.

It is additionally contemplated that the head piece comprises a plurality of panels that extend from a front edge of the head piece to the neck hole. The panels may include a left side panel, a middle panel and a right side panel. The left side panel is attached to the middle panel at a first seam and the right side panel is attached to the middle panel at a second seam. One of the rear edges of the hinge portions is attached to the head piece at the first seem and the other of the rear edges of the hinge portions is attached to the head piece at the second seam.

A method of positioning a hood while being worn by a user is also provided. The method includes positioning the lid to cover a head portion of a user and positioning the mask to cover a portion of the user's face. The mask has opposite side portions with rear edges attached to the lid, such that the mask is pivoted around the rear edges. Upper edges of the side portions slide along an outside of the lid when the mask is moved, so as to change a facial coverage area of the mask.

Features of the invention include the ability of the hood to obtain varying amounts of coverage to a user's face and head area. Also, the hood's fabric disperses heat from hotter areas of the user's head to regulate temperature and wick away moisture to keep the user's skin dry and warm in a wide range of climates.

BRIEF DESCRIPTION OF THE DRAWINGS

Aspects of the present invention will become more apparent by describing in detail non-limiting embodiments thereof with reference to the attached drawings, in which.

DETAILED DESCRIPTION OF ILLUSTRATIVE NON-LIMITING EMBODIMENTS

The following description of illustrative, non-limiting embodiments of the apparatus and method discloses specific configurations and components. However, the embodiments are merely examples of the present invention and, thus, the specific features described below are merely used to more easily describe such embodiments and to provide an overall understanding of the present invention. Accordingly, one skilled in the art will readily recognize that the present invention is not limited to the specific embodiments described below. Furthermore, the descriptions of various configurations, components, processes and operations of the embodiments that are known to one skilled in the art are omitted for the sake of clarity and brevity.

Figure 1:
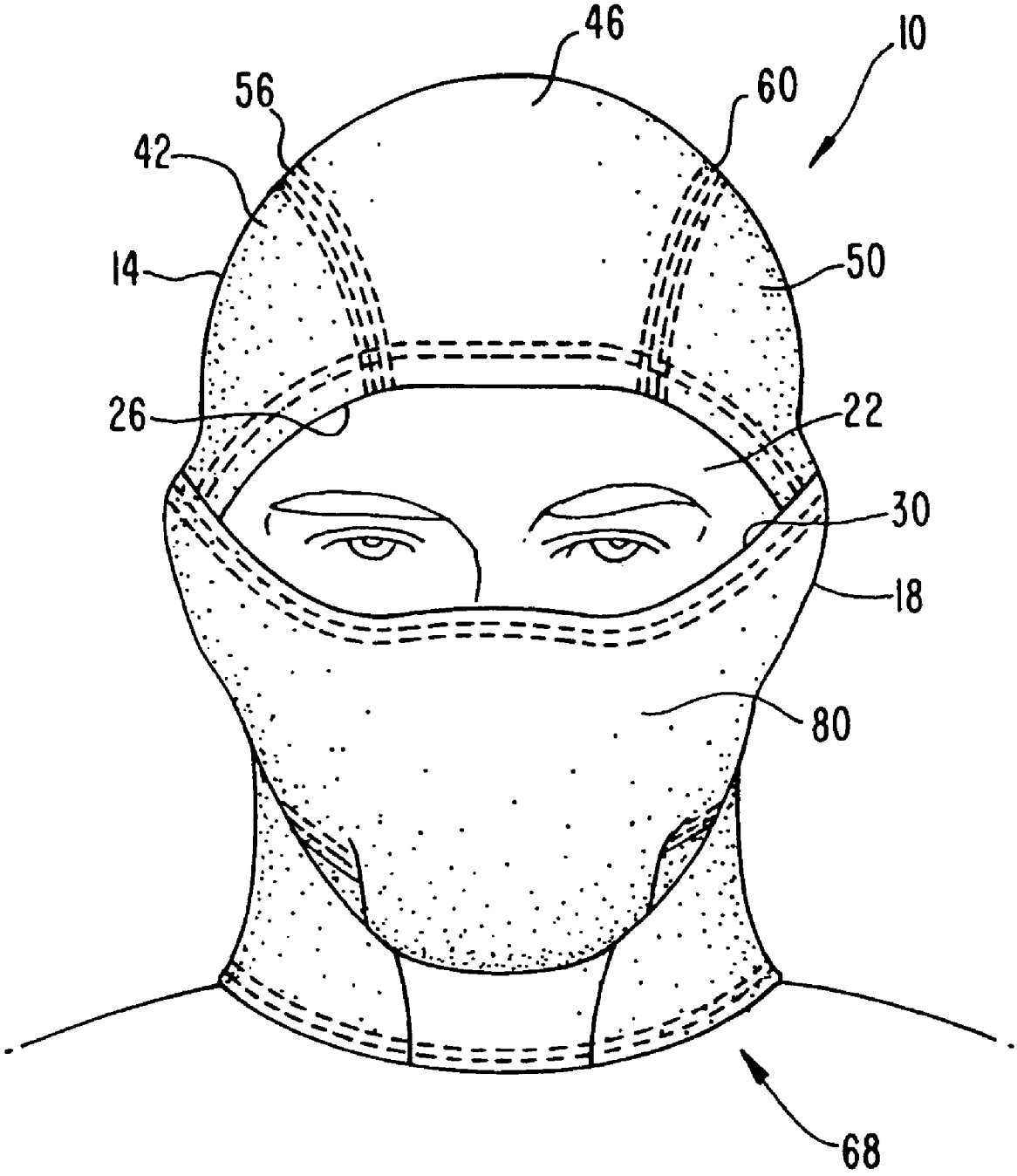
FIG. 1 is a front view of an embodiment of the hood in a first position.

As illustrated in FIG. 1, a hood 10 according to an exemplary embodiment includes a head piece or lid 14 for covering a head of a user. A mask or face piece 18 is coupled with the head piece 14 for covering a face of the user throughout a range of covering positions. The head piece 14 and mask piece 18 are positioned in relationship with one another to form an aperture or opening 22 for a portion or all of the user's face, as will be discussed below. The opening 22 is circumscribed by an edge portion 26 of the head piece 14 and an edge portion 30 of the mask piece 18 so as to be adjustably enlarged or reduced depending on a desired amount of coverage, as will be described later.

Figure 2A:
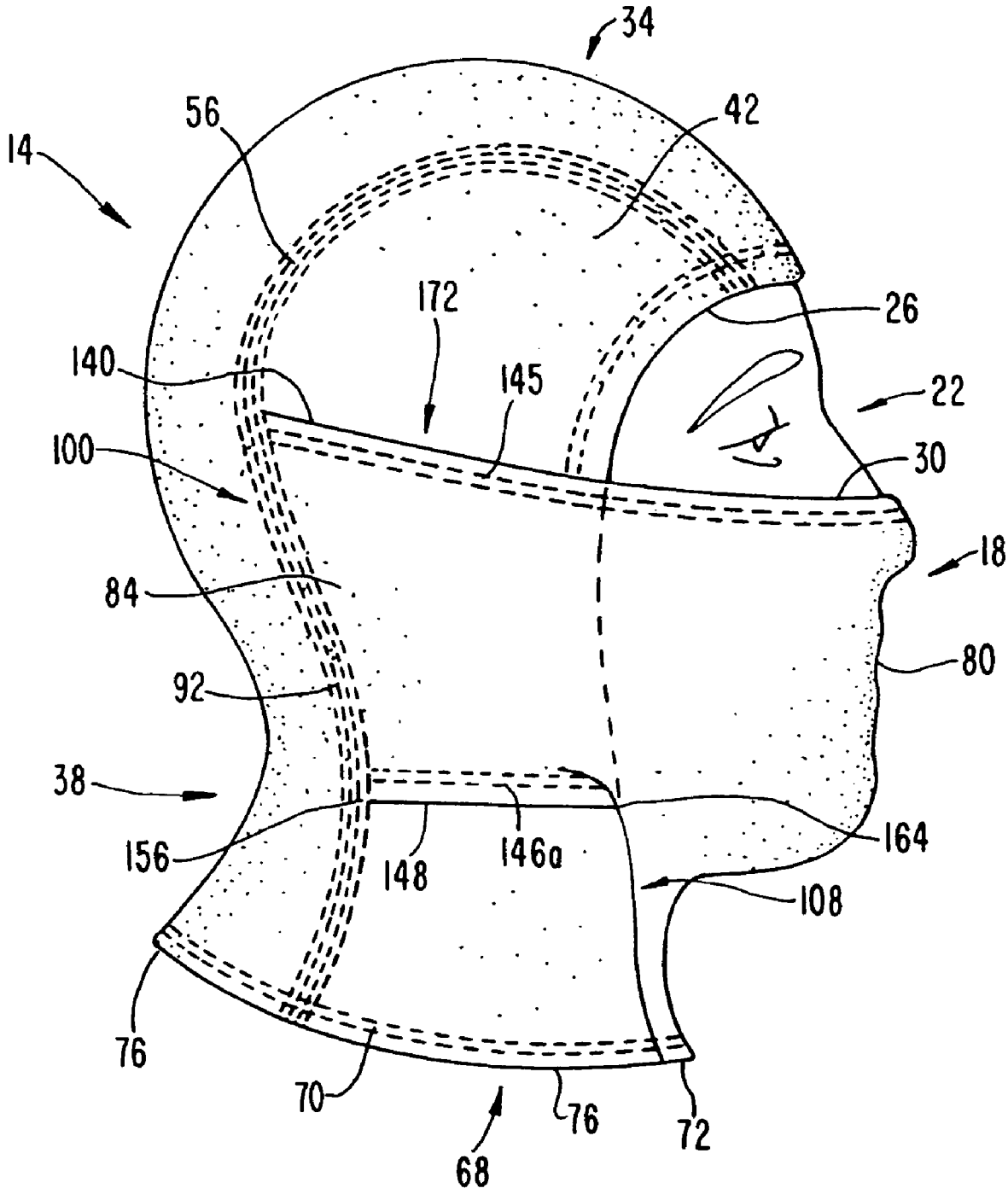
FIGS. 2A and 2B are side views of the hood in FIG. 1.
Figure 2B:
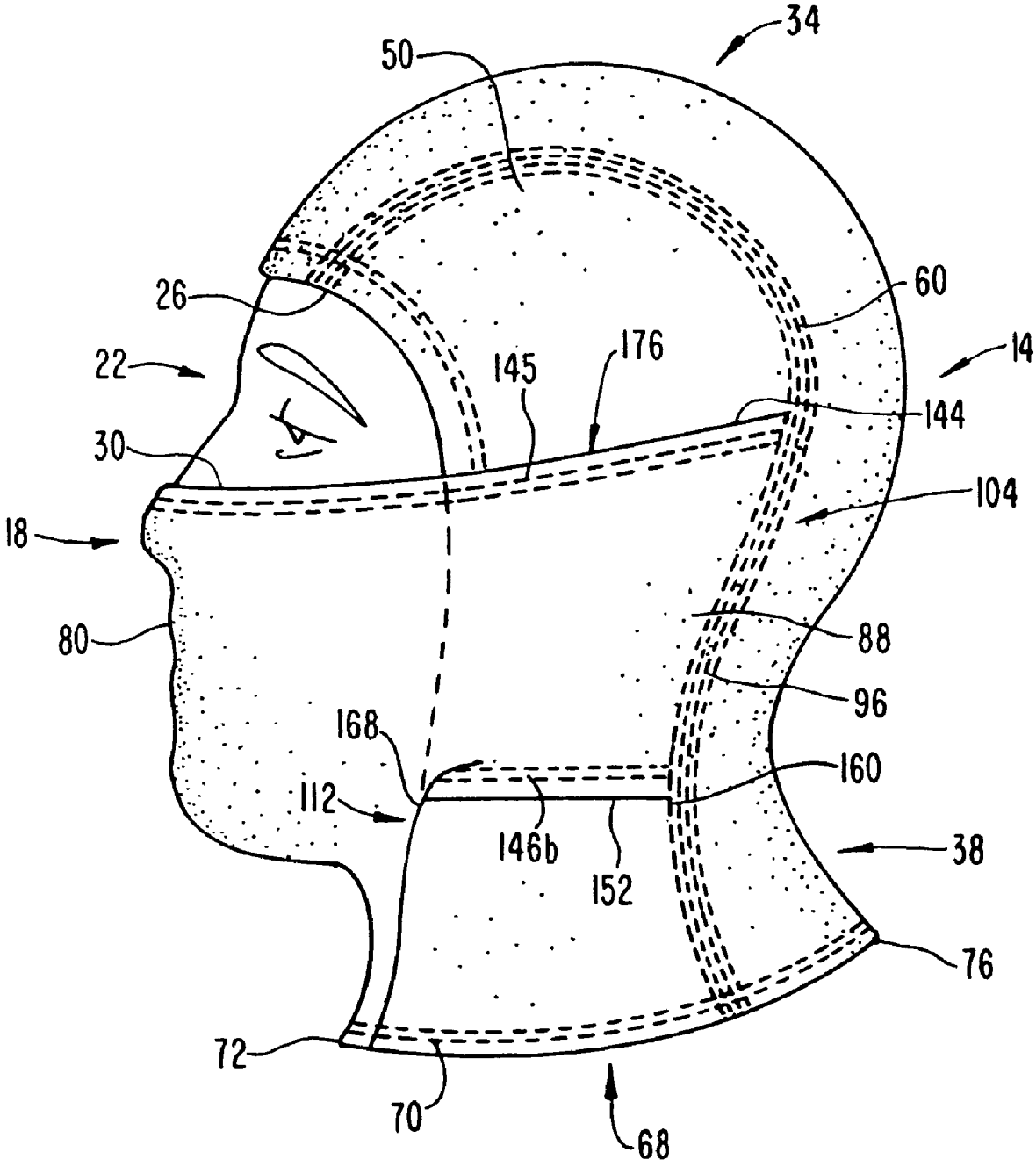
Figure 3:
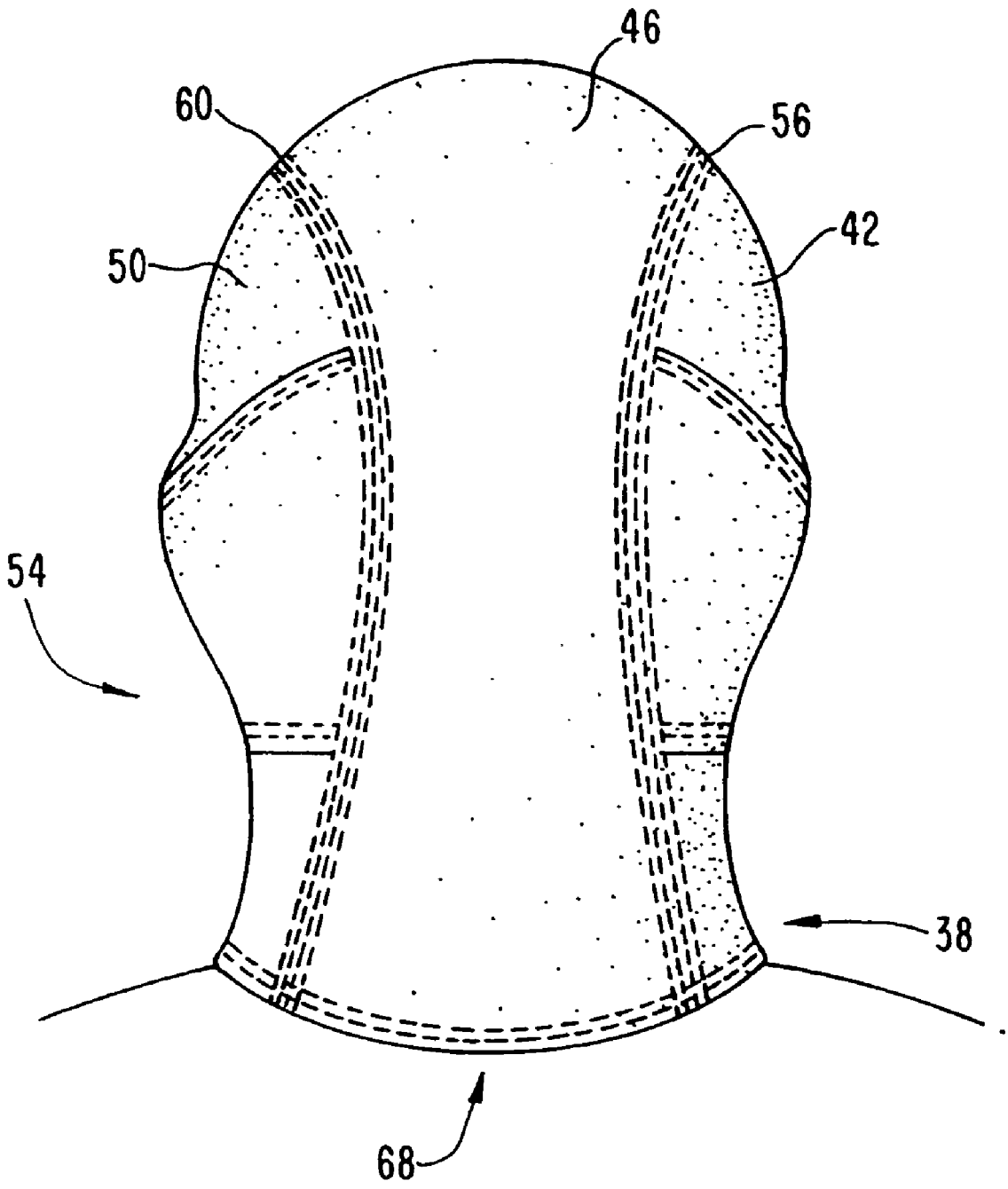
FIG. 3 is a rear view of the hood in FIG. 1.

With additional reference to FIGS. 2A and 2B, the head piece 14 may be constructed of three panels that extend from a crown portion 34 to a back lower portion 38 of the head piece. In an exemplary embodiment, the panels include a left panel 42, a middle panel 46 and a right panel 50, as shown in FIG. 1. A rear portion 54 of the hood (see, FIG. 3) also includes the left panel 42, the middle panel 46 and the right panel 50, which extend to the lower portion 38 of the head piece 14. A first seam 56 is located between the left panel 42 and the middle panel 46 and a second seam 60 is provided between the right panel 50 and the middle panel 46. An emblem may be disposed on any visible portion of the mask 18 or head piece 14 to represent a manufacturer or to distinguish a member of one team from another.

Referring again to FIGS. 2A and 2B, a neck hole 68 is provided at a lower portion of the hood 10 and is defined by a lower edge 72 of the mask piece 18 and a lower edge 76 of the head piece 14. A seam 70 may be provided above the neck hole 68 to add support and elasticity to the lower portion 38 of the hood 10. The seam 70 may also act to stop a tear in the event that the lower portion 38 of the hood 10 is subjected to a shear force that would otherwise damage the hood 10.

The mask piece 18 includes a face covering portion 80, along with a left hinge or side portion 84 (shown in FIG. 2A) and a right hinge or side portion 88 (shown in FIG. 2B) that extend along sides of the hood 10. The hinge portions 84, 88 have rear edges 92, 96 that provide a set of connection areas 100, 104 between the mask piece 18 and head piece 14. In an exemplary embodiment, the rear edge 92 of the hinge portion 84 is fastened to the head piece 14 along the first seam 56. Likewise, the right hinge portion 88 is fastened to the head piece 14 along the second seam 60. Both hinge portions 84, 88 may have a height that increases towards a rear of the hood 10.

The mask piece 18 is sewn to the left and right panels 42, 50 of the head piece 14 at an additional set of connection areas 108 (shown in FIG. 2A) and 112 (shown in FIG. 2B), which are horizontally offset from the connection areas 100, 104. These areas 108, 112 respectively extend in a top-to-bottom direction and are disposed lower than the connection areas 100, 104. The mask piece 18 is also shaped so that it widens from the connection areas 100, 104 to the connection areas 108, 112.

The hinge portions 84, 88 further include upper edges 140 (shown in FIG. 2A) and 144 (shown in FIG. 2B) and lower edges 148, 152. The upper edges 140, 144 reach to tops of the connection areas 100, 104 and extend around a front of the mask piece 18 to converge with the edge portion 30 that bounds the opening 22. A seam 145 may be provided to extend around a periphery of the mask piece 18 to add support and elasticity to upper areas of the hinge portions 84, 88 and the face covering portion 80. Similarly, seams 146*a*, 146*b* may be provided respectively at lower areas of the hinge portions 84, 88, that extend from the first and second seams 56, 60 to the face covering portion 80. The seams 145, 146*a* and 146*b* also add to the integrity of the hood 10 by providing a resistance to ripping in the event that the mask piece 18 is extensively pulled by the user or an opponent.

Referring again to FIGS. 2A and 2B, the lower edges 148, 152 extend from bottoms 156, 160 of the rear edges 92, 96 to tops 164, 168 of the connection areas 108, 112. It is preferable, but not necessary, that the mask piece 18 is only attached to the head piece 14 at the connection areas 100, 104, 108 and 112. This permits the mask piece 18 to move independently from the head piece 14 and creates an unattached portion 172 (shown in FIG. 2A) and 176 (shown in FIG. 2B) of the mask piece 18 that extends over the head piece 14. In effect, the unattached portions 172 and 176 form through holes between the mask piece 18 and the head piece 14. Thus, when the mask piece 18 is adjusted, it can slide along the head piece 14 without being unduly stretched. As will be appreciated, when the hood 10 is worn by a user, the unattached portions 172, 176 will be drawn to the head piece 14 due to a tension in the hood material; however, the mask piece 18 and the head piece 14 will still be permitted to move independently.

The first connection areas 100, 104 and hinge portions 84, 88 permit the mask piece 18 to be moved or pivoted in an upward or downward direction. Likewise, the head piece 14 may be rolled to a posterior area of a user's head by pivoting the head piece 14 around the connection areas 100, 104. The second connection areas 108, 112 also act as pivot points for the hood piece 14 to be rotated around the mask piece 18, along with providing support for the mask piece 18.

In an exemplary embodiment, the hood 10 is thin enough to provide form-fitting comfort on its own or beneath a helmet worn during, for example, football, lacrosse, motocross racing and the like. However, it will be understood that the hood 10 can be worn underneath any type of head gear where the user desires additional protection and temperature control. The material used for the hood may be a double-sided fabric such as that used in UNDER ARMOUR'S® COLDGEAR® category that acts to disperse moisture from the user's head.

For example, the material may comprise 6.5 oz/yd nylon (63%), polyester (25%), elastane (12%) knit fabric that will wick moisture from the body. A compression fabric is preferably used that provides a stretch fit and support, such as one having a high spandex content. The mean length stretch may be 140% at 10 lbs of load, and the mean width stretch may be 110% at 10 lbs of load. This fabric also may have a wicking finish applied to it. It will be appreciated that other materials may also be used such as, but not limited to microfibers, including nylon, polyester, or elastane blends thereof and the like.

Figure 4:
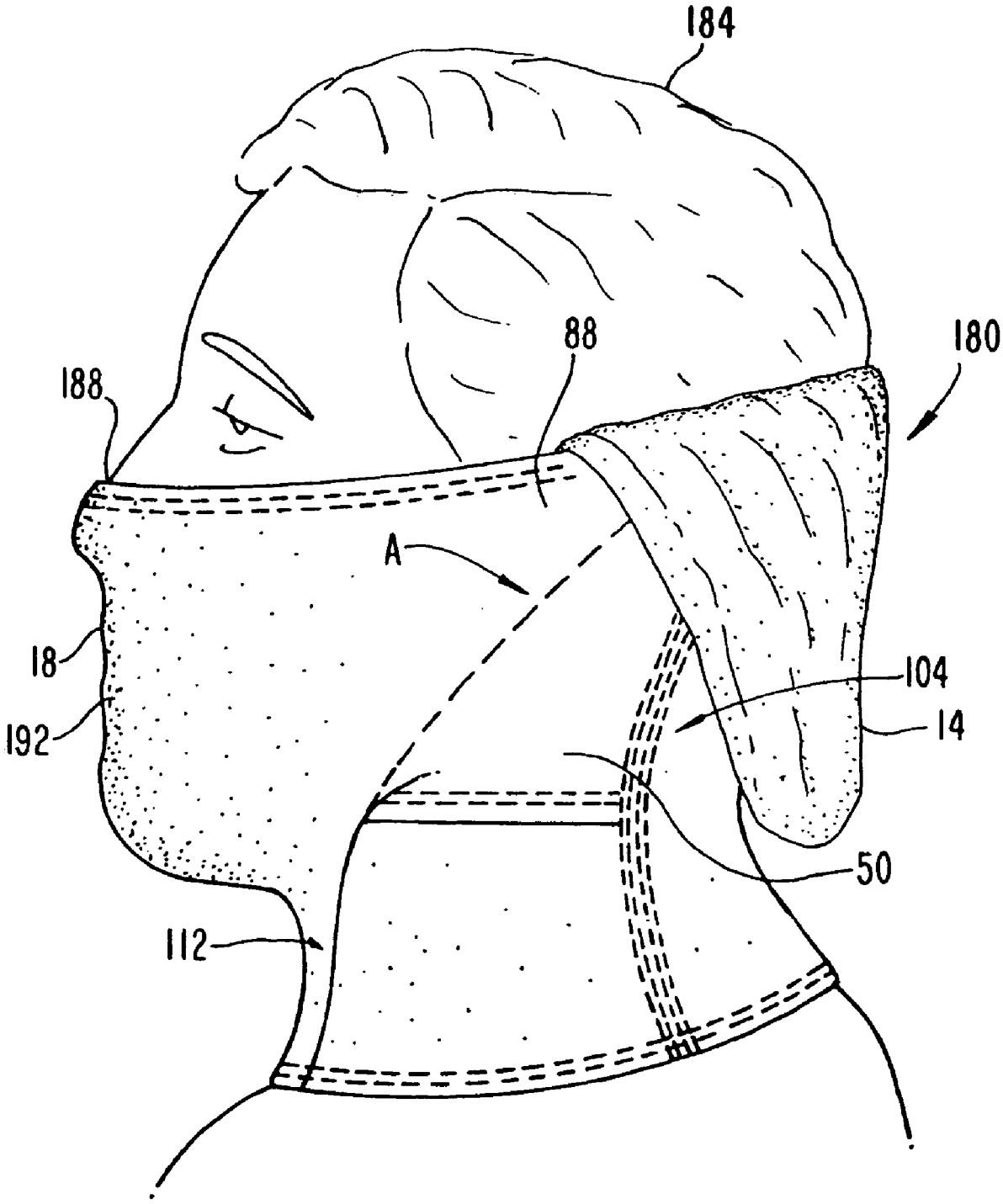
FIG. 4 is a side view of an embodiment, showing a top portion of the hood pulled to a back of a user's head.

Turning to FIG. 4, the hood 10 is shown with the head piece 14 being slid to the back side or the posterior area 180 of a user's head 184 to provide a half-covered position. This position may be obtained by the user pulling the edge 26 or pushing the crown portion 34 up-and-over the head 184 to displace the head piece 14 and thereby expose a top portion of the user's head 184. This position may be desirable when environmental conditions do not require full head protection or when a user wishes to release heat from the head area.

The half coverage position in accordance with an exemplary embodiment is obtainable while not significantly impacting a position of the mask piece 18. For example, if a user is wearing the hood 10 in the full coverage position, as shown in FIG. 1, he would be able to pull the head piece 14 to the back 180 of his head 184 while maintaining the mask piece 18 in a position which covers his nose 188 and mouth 192 while not significantly inducing tension in the mask piece 18. This is, in-part, made possible by the hinge portions 84, 88 that are slidably in contact with the head piece 14 to permit the edge 26 of the head piece 14 to move to the location "A" beneath the mask piece 18. In particular, with additional reference to FIGS. 2A and 2B, as the head piece 14 is pulled back, the material constituting the left 42 and right 50 side panels is permitted to slide beneath the hinge portions 84, 88 to allow a sufficient amount of material to travel upward and over the user's head 184 without causing an undue amount of tension on the user's head 184. In addition, the first set of connection areas 100, 104 become a pivotal area for the crown 34 of the head piece 14 to rotate around (see, FIG. 4). The second connection areas 108, 112 also contribute to maintaining the position of the mask piece 18, while providing a point around which the head piece 14 rotates.

Figure 5A:
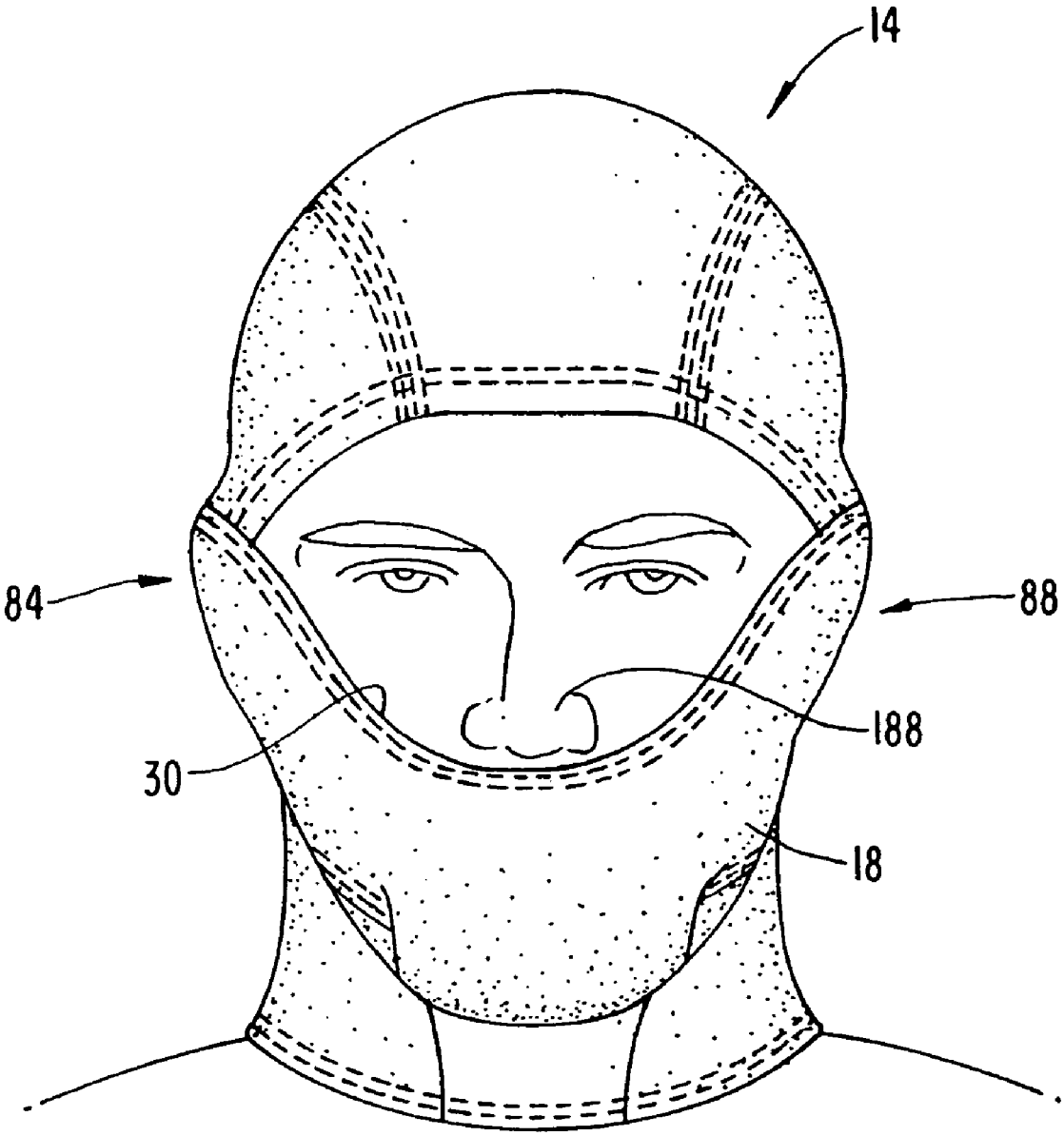
FIG. 5A is a front view of an embodiment, showing a lower portion of the hood pulled below a user's nose.
Figure 5B:
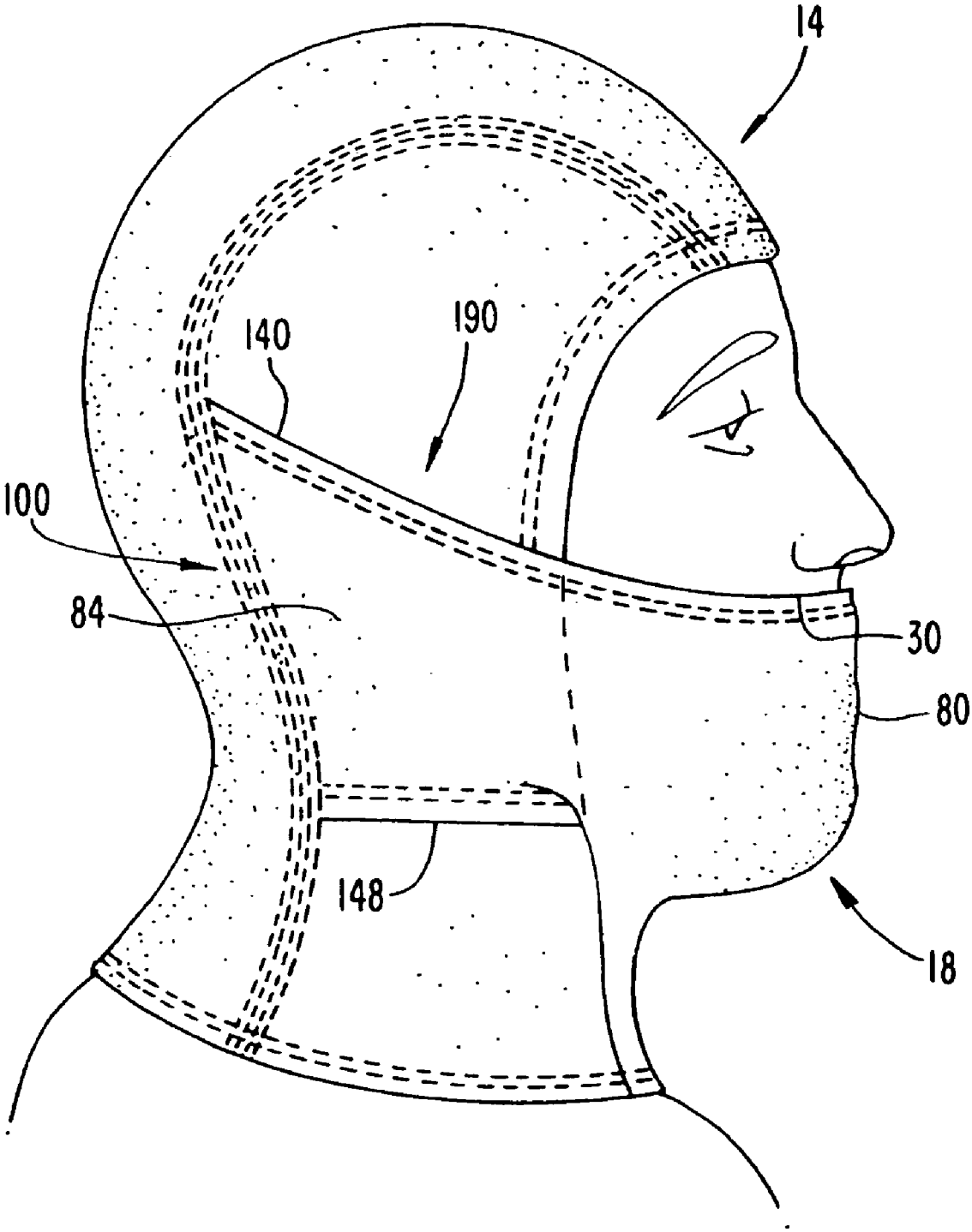
FIG. 5B is a side view of the hood in FIG. 5A, showing the lower portion pulled below the user's nose.

FIGS. 5A and 5B illustrate the mask piece 18 of FIG. 1 while in a vented position. As shown, the mask piece 18 is pulled to a position below the nose 188 of the user, while maintaining coverage of the user's mouth. This position may be desirable to a user who wishes to maintain the protective benefits of the hood 10, while not covering the nose portion 188. It will be appreciated that an embodiment of the invention utilizes a material that permits sufficient airflow for proper breathing even during strenuous physical activity. However, if a user desires a completely unrestricted flow of air through his nose 188, the invention permits one to easily obtain the vented position of FIGS. 5A and 5B. The independently movable aspects of the mask piece 18 and the head piece 14 further add to the beneficial features of the invention by not requiring the material of the mask piece 18 and head piece 14 to be unduly stretched and by reducing stress that would otherwise be applied to a bottom of a user's nose 188 upon rolling back the head piece 14. In addition, the elasticity of the fabric provides a sufficient compression force to maintain the head piece 14 and mask piece 18 in the various positions described herein.

With additional reference to FIGS. 2A and 2B, moving the mask piece 18 downward to obtain the vented position is assisted by the interaction between the hinge portions 84, 88 and the head piece 14. In particular, because the hinge portions 84, 88 are permitted to slide along an outer surface area 190 of the head piece 14, the user does not have to fight to stretch a unitary piece of material that extends from a crown portion to a chin area, as in a one-piece, non-segmented construction. Further, the connection areas 100, 104 (FIGS. 2A, 2B and 5B) act as pivot points to maintain the position of the ends of the upper edges 172, 176 attached to the rear edges 92, 96, while allowing the front edge portion 30 of the mask piece 18 to swing in the downward direction.

Figure 6:
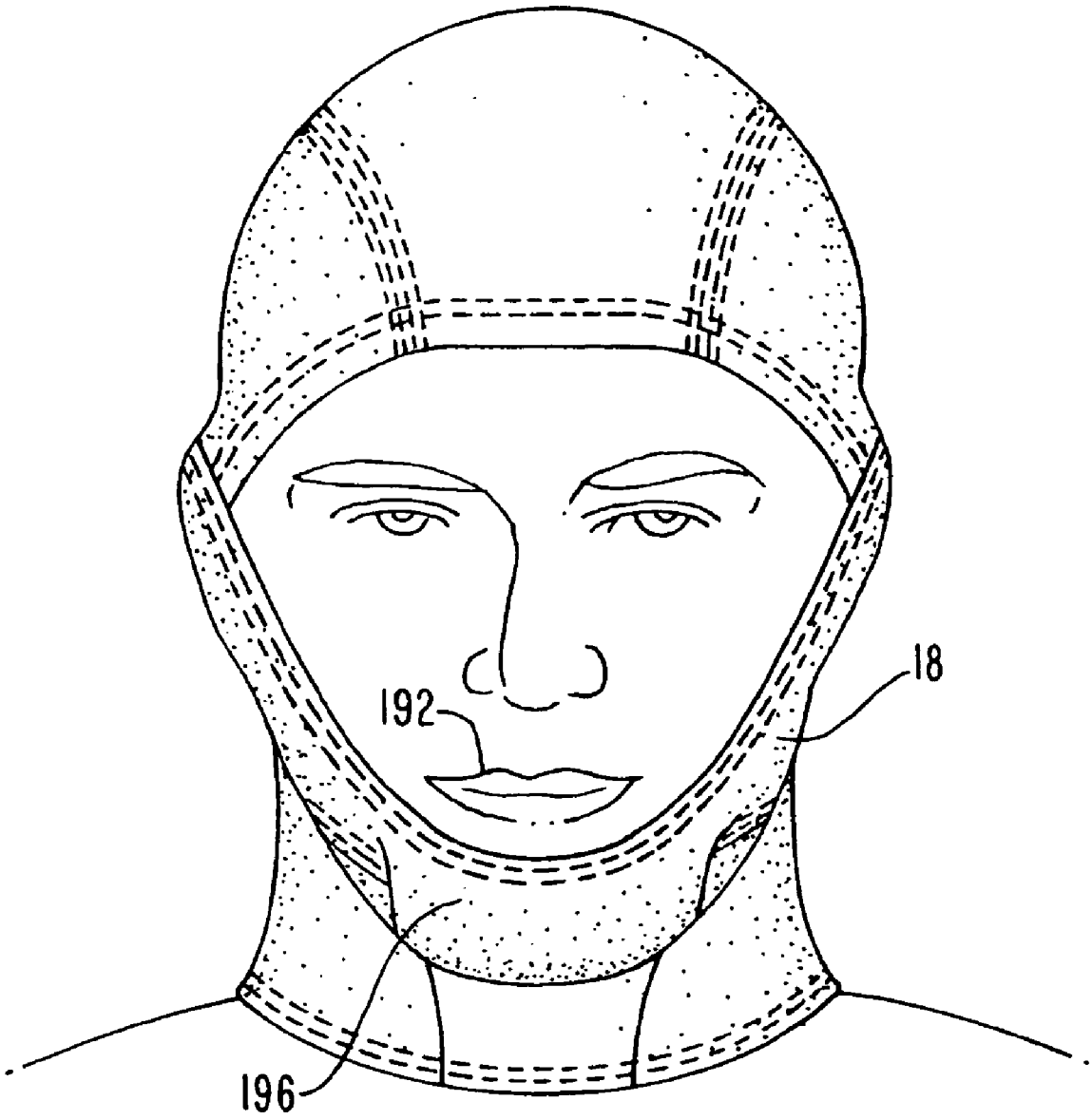
FIG. 6 is a front view of an embodiment, showing a lower portion of the hood pulled below a user's mouth.

FIG. 6 illustrates a positioning of the hood in a full-vented position. This position is similar to the positioning of FIG. 5, except the mask piece 18 is pulled to an area below the mouth 192 of the user so as to rest on a user's chin area 196. As with the vented position of FIG. 5, the mask piece is set in the full-vented position by pulling the mask piece 18 downward. In particular, the hinge portions 84, 88 are pulled further downward along the outer surface of the head piece 14. The connection areas 100, 104 continue to act as a pivotal area for the hinge portions 84, 88, while the separability of the mask piece 18 and head piece 14 allow the mask piece 14 to move in the downward direction without causing unnecessary stretching in the head piece 18. The full-vented position of FIG. 6 would permit completely unhindered breathing through both the user's nose and mouth.

Figure 7:
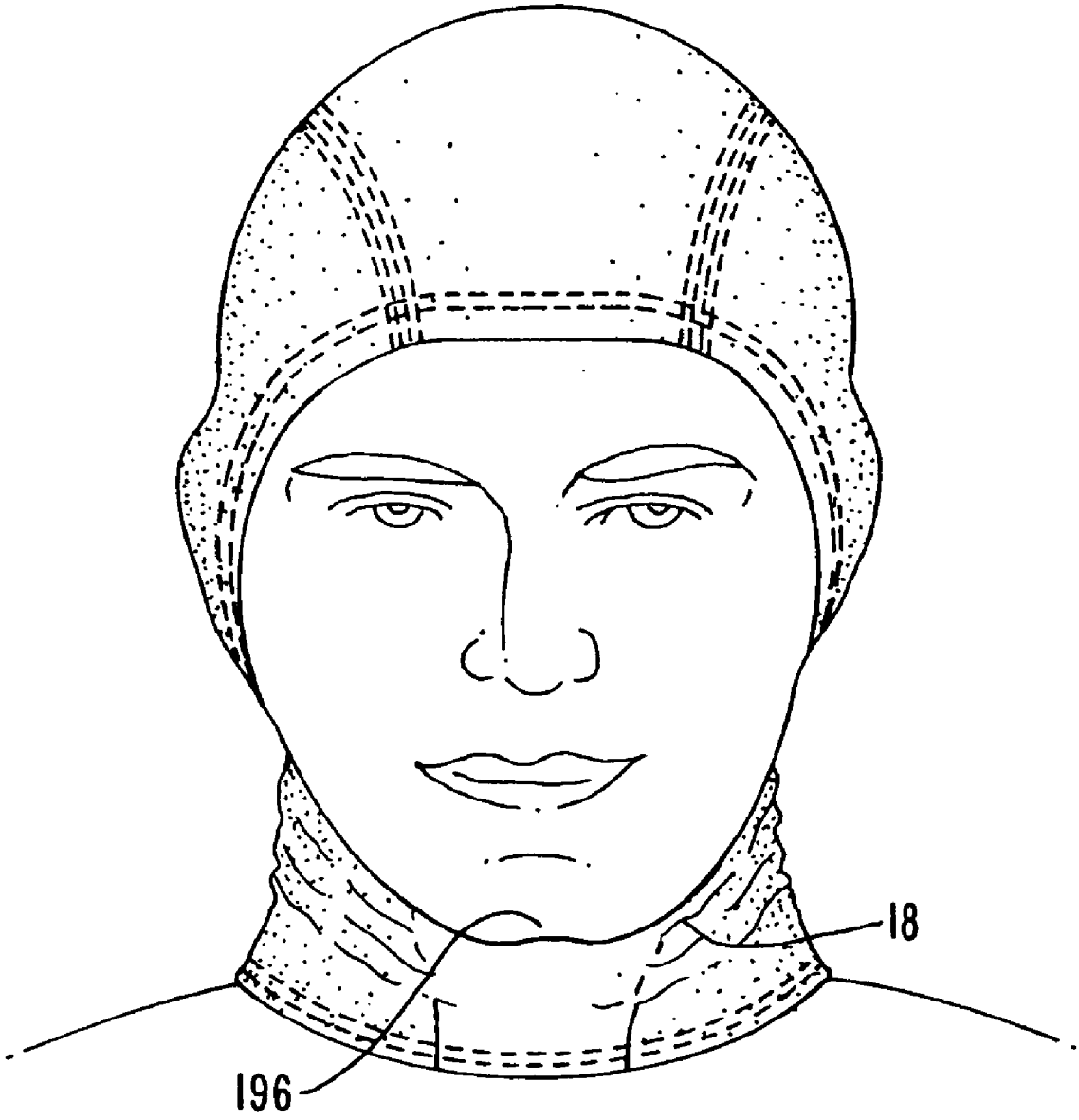
FIG. 7 is a front view of an embodiment, showing the hood pulled down around a neck area of a user.

FIG. 7 illustrates a positioning of the hood 10 in an under-the-chin position. This position is similar to the positioning of FIGS. 5 and 6, except the mask piece 18 is pulled to an area below the user's chin 196. This position is obtained in the same manner as those in FIGS. 5 and 6. A user may desire the under-the-chin position to obtain the unhindered breathing of the full vented position, while maximizing a cooling effect to the user's face area.

Although the embodiments of FIGS. 5, 6 and 7 are illustrated with the head piece in the up-position so as to cover the user's head 184, it will be understood that the head piece 14 may be pulled to the back area 180 of the head 184 in any of these embodiments in the same manner described in regard to FIG. 4. Thus, the invention provides a versatile, stylish and functional hood that can efficiently adapt to changing environments to thereby maximize comfort and regulate heat. Further, the head piece 14 and the mask piece 18 can be disposed in the desired positions and maintained in place due to the compressive aspects of the fabric.

The previous description of the exemplary embodiments is provided to enable a person skilled in the art to make and use the present invention. Moreover, various modifications to these embodiments will be readily apparent to those skilled in the art, and the generic principles and specific examples defined herein may be applied to other embodiments without the use of inventive faculty. Therefore, the present invention is not intended to be limited to the embodiments described herein, but is to be accorded the widest scope as defined by the limitations of the claims and equivalents thereof.

What is claimed is:

1. A hood to be worn on a user's head, the hood comprising:

a lid; and a mask pivotally attached to the lid, the mask having a right side and a left side that respectively overlap the lid and slide along the lid when the mask is lowered or raised, wherein the right side of the mask and the left side of the mask each have a first connection area and a second connection area that attach the mask to the lid, the first connection area being separate from the second connection area, and the first connection area is at a rear of the mask and the second connection area is positioned between the rear of the mask and a front of the mask, such that the second connection area is offset horizontally from the first connection area, wherein the second connection area is lower than the first connection area such that an upper edge of the second connection area is offset horizontally from a bottom edge of the first connection area and extends vertically to a bottom of the lid wherein the right side and the left side of the mask each have a portion that is separable from the lid to form a through hole that opens at the upper edge and exits at the lower edge.

2. The hood of claim 1, wherein the mask and the lid circumscribe an opening such that when the mask pivots, the size of the opening increases or decreases.

3. The hood of claim 1, wherein a bottom edge of the lid and the mask define a neck hole, and wherein the right side and left side of the mask each have an upper edge and a lower edge, and the lower edge of each of the right side of the mask and the left side of the mask is positioned above the neck hole.

4. The hood of claim 1, wherein the lid has an edge which borders part of an opening, and the lid is configured to be disposed on a user's head in one of an up-position and a down-position, the edge of the lid being disposed on a user's forehead when in the up-position and the edge of the lid being disposed on a posterior of a user's head while in the down-position.

5. The hood of claim 4, wherein the mask forms a hinge which allows the mask to be moved from a first position, which covers a nose of the user, to second position, which is below the user's nose and over a mouth of the user, by moving the mask in a downward direction such that an edge of the mask slides along an outside of the lid.

6. The hood of claim 5, wherein the mask is operable to be moved from the second position to a third position that is below the mouth of the user and on a chin of the user.

7. The hood of claim 6, wherein the mask is operable to be moved from the third position to a fourth position that is under the chin of the user.

8. The hood of claim 1, wherein the mask and lid are made of a compression fabric that forms a tight fit on the user's head.

9. The hood of claim 1, wherein the mask is positioned outside the lid.

10. The hood of claim 1, wherein the lid comprises elastane so as to provide a stretch fit.

11. A hood to be worn on a user's head, the hood comprising:

a head piece having a crown portion and a lower edge; and a face piece having, a lower edge that is attached to the lower edge of the head piece to define a neck hole; and hinge portions that are attached to the head piece, wherein the hinge portions each have a lower edge that extends towards a back of the hood and is positioned above the neck hole;

wherein the hinge portions each have a rear edge that is attached to the head piece to form a first set of connection areas;

wherein the head piece comprises a left side panel, a middle panel and a right side panel, the left side panel is attached to the middle panel at a first seam and the right side panel is attached to the middle panel at a second seam, and wherein one of the rear edges of the hinge portions is attached to the head piece at the first seam and the other of the rear edges of the hinge portions is attached to the head piece at the second seam.

12. The hood of claim 11, wherein the head piece is separately movable from the face piece.

13. The hood of claim 11, wherein the hinge portions have upper edges, and the upper and lower edges of the hinge portions are separable from the head piece.

14. The hood of claim 11, wherein the face piece is additionally attached to the head piece at a second set of connection areas disposed lower than the first set of connection areas.

15. The hood of claim 14, wherein the hinge portions each include an upper edge and a lower edge, and an area of the hinge portions, between the first and second connection areas, overlaps the head piece in an unattached state to permit relative movement between the head piece and the face piece.

16. The hood of claim 11, wherein the head piece comprises a plurality of panels that extend from a front edge of the head piece to the neck hole.

17. The hood of claim 11, wherein the head piece has an upper edge which borders part of a opening, and the head piece is configured to be disposed on a user's head in one of an up-position and a down-position, the upper edge of the head piece being disposed on a user's forehead when in the up-position, and the upper edge of the head piece being disposed on a posterior of a user's head while in the down-position.

18. The hood of claim 17, wherein a part of the hinge portions, respectively, is attached to the head piece to allow the face piece to be moved from a first position, which covers a nose of the user, to a second position, which is below the user's nose and over a mouth of the user, by moving the face piece in a downward direction such that an upper edge of the respective hinge portions slides along an outside of the head piece.

19. The hood of claim 18, wherein the face piece is operable to be moved from the second position to a third position that is below the mouth of the user and on a chin of the user.

20. The hood of claim 19, wherein the face piece is operable to be moved from the third position to a fourth position that is under the chin of the user.

21. The hood of claim 11, wherein the face piece is positioned outside the head piece.

22. The hood of claim 11, wherein the head piece comprises elastane so as to provide a stretch fit.

23. A hood to be worn on a user's head, the hood comprising:

a head piece having a crown portion and a lower edge; and a face piece having, a lower edge that is attached to the lower edge of the head piece to define a neck hole; and hinge portions that are attached to the head piece, wherein the hinge portions each have a lower edge that extends towards a back of the hood and is positioned above the neck hole;

wherein the hinge portions each have a rear edge that is attached to the head piece to form a first set of connection areas;

wherein the face piece is additionally attached to the head piece at a second set of connection areas disposed lower than the first set of connection areas wherein the hinge portions have a width that is tapered in a direction from the first set of connection areas to the second set of connection areas.

* * * * *